US006041490A

United States Patent [19]

Tabuchi et al.

[11] Patent Number: 6,041,490

[45] Date of Patent: Mar. 28, 2000

[54] METHOD FOR MANUFACTURING PULLEY INTEGRATED ROTOR

[75] Inventors: Yasuo Tabuchi, Toyoake; Yasuji Kasuya, Okazaki; Hiroshi Shohara, Toyohashi; Satoshi Kawakami, Kariya, all of Japan

[73] Assignee: Denso Corporation, Kariya, Japan

[21] Appl. No.: 09/129,667

[22] Filed: Aug. 5, 1998

[30] Foreign Application Priority Data

Aug. 7, 1997 [JP] Japan ..... 9-213548

[51] Int. Cl.[7] ..... H01F 41/02

[52] U.S. Cl. ..... 29/607; 29/602.1; 29/892; 192/184.31

[58] Field of Search ..... 29/607, 602.1, 29/892; 192/184.31, 184.3

[56] References Cited

U.S. PATENT DOCUMENTS

| | | | |
|---|---|---|---|
| 5,123,157 | 6/1992 | Cerny | 29/607 |
| 5,642,560 | 7/1997 | Tabuchi et al. | 29/607 |
| 5,920,981 | 7/1999 | Bushelle et al. | 29/607 |

*Primary Examiner*—Carl E. Hall
*Attorney, Agent, or Firm*—Harness, Dickey & Pierce, PLC

[57] ABSTRACT

A workpiece W2 is grasped by inserting a first jig into a concave portion which is formed in a rotor forming process, and by interfitting a second jig to a convex portion which is also formed in the rotor forming process. Thereby, the workpiece W2 is firmly grasped, and a groove-forming roller can be strongly pressed into the workpiece W2. A time for forming a pulley groove is shortened, and a manufacturing cost thereof is reduced.

6 Claims, 13 Drawing Sheets

METHOD FOR MANUFACTURING PULLEY INTEGRATED ROTOR

CROSS REFERENCE TO RELATED APPLICATION

This application is based on and incorporates herein by reference Japanese Patent Application No. Hei. 9-213548 filed on Aug. 7, 1997.

BACKGROUND OF THE INVENTION

1. Field of the Invention

The present invention relates to a method for manufacturing a pulley integrated rotor for an electromagnetic clutch, in which a pulley member and a rotor member are integrated with each other.

2. Description of Related Art

Conventionally, as shown in FIG. 24, in an electromagnetic clutch manufacturing process, a pulley member 11 and a rotor member 12 are individually assembled and then welded together.

However, in the conventional manufacturing method, it is difficult to ensure a high concentric accuracy between the pulley member 11 and the rotor member 12 connected to each other, because of accumulation tolerances of the pulley member 11 and the rotor member 12, and connection tolerance between these members 11, 12. Therefore, the accumulation tolerances and the connection tolerance need to be strictly controlled, thereby increasing the manufacturing cost of the electromagnetic clutch.

Generally, a pulley groove 11*a* is formed by a plastic-forming process, such as a roll-forming process, to reduce the manufacturing cost. In the plastic-forming process, because a large force acts on the outer periphery of the pulley member to plastically deform the same, the pulley member has to be grasped firmly during the plastic-forming process.

However, it is difficult to grasp the pulley integrated type rotor at outer periphery thereof, because the pulley groove is formed at the outer periphery of the pulley member.

SUMMARY OF THE INVENTION

An object of the present invention is to provide a method for manufacturing a pulley integrated rotor for an electromagnetic clutch.

According to the present invention, a rotor member and a concave portion, which functions as a magnetic breaker space penetrating the rotor member in an axial direction of an electromagnetic clutch, are formed by plastic-forming a disk material in a rotor member forming steps. Next, a jig is inserted into the concave portion in order to grasp the rotor. A pulley groove is then formed by plastic-forming the workpiece.

As described above, the workpiece is firmly grasped by the jig at the concave portion, not at the outer periphery of the rotor member. Therefore, the pulley groove can be formed by a plastic forming process to deform the outer periphery of the rotor member, while a high yield production is maintained. As a result, the pulley integrated rotor may be manufactured without any associated increased manufacturing costs.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS (First Embodiment)

Figure 1:
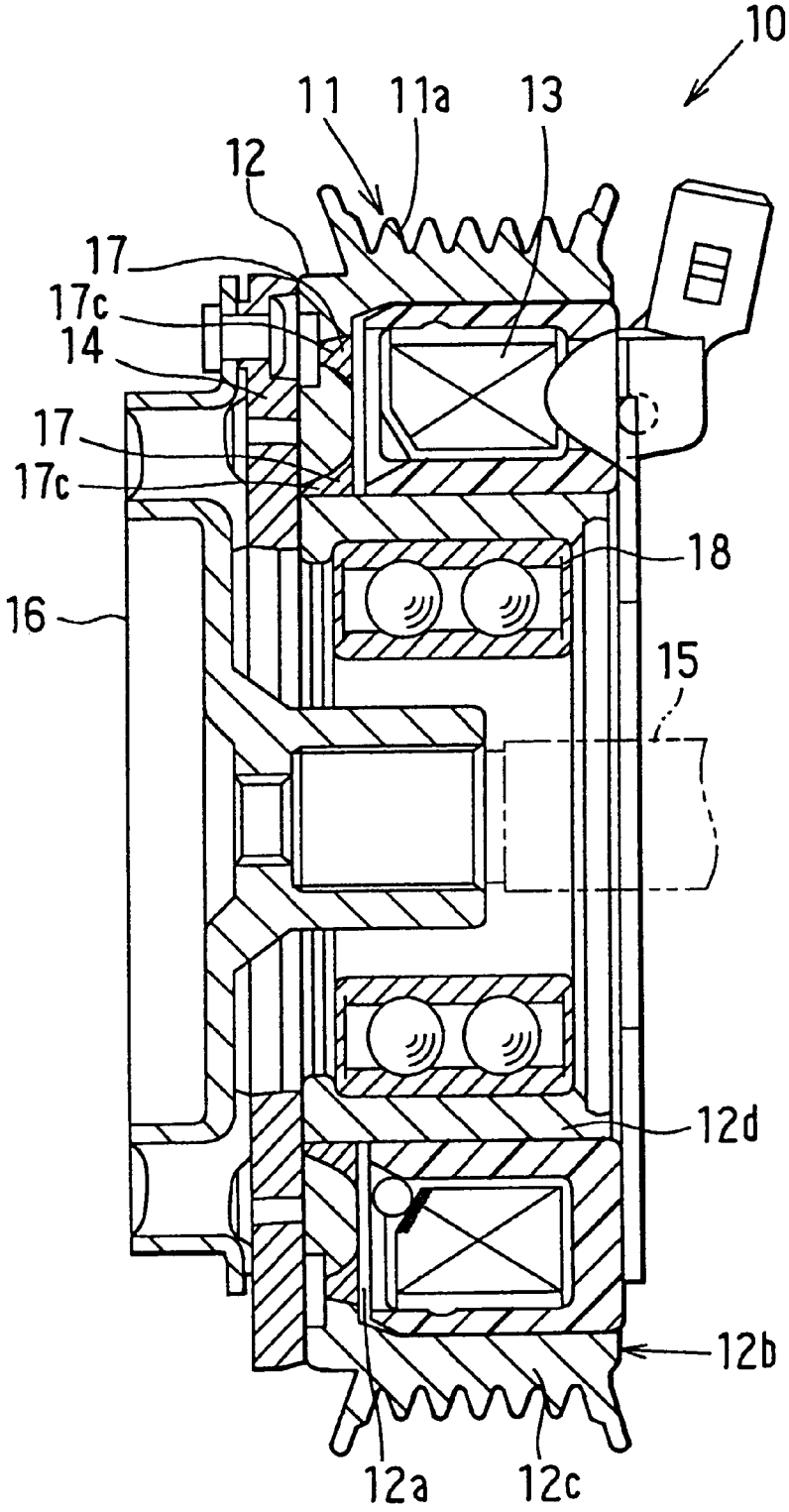
FIG. 1 is a cross sectional view showing an electromagnetic clutch (first embodiment)

FIG. 1 shows an electromagnetic clutch 10 having a rotor integrated with a pulley. The electromagnetic clutch 10 transmits a driving force from a vehicle engine (not illustrated) to a compressor (not illustrated) for intermittent operation of a vehicle refrigerant cycle intermittently. Hereinafter, a detailed structure of the electromagnetic clutch 10 will be described.

A pulley member 11 has grooves 11*a* on which a V-belt (not illustrated) is hung. A rotor member 12 includes a double cylindrical pipe portion 12*b*, and integrally rotates with the pulley member 11. The pulley member is integrally formed with the rotor member 12.

The rotor member 12 functions as a part of a magnetic circuit for magnetic flux generated by an exciting coil 13. The exciting coil 13 is installed into a ring-shaped space 12*a* formed between an inner cylindrical portion 12*d* and an outer cylindrical portion 12*c* of the double cylindrical pipe portion 12*b*.

An armature 14 is connected to the shaft 15 of the compressor through a hub 16, and is attracted by the rotor 12 when electric current is supplied to the exciting coil 13. The rotor 12 includes a magnetic breaker space 17 (penetrating slit) in the surface facing the armature 14, which penetrates the clutch surface in the axial direction (right and left direction in FIG. 1). Because the magnetic breaker space 17 has a circular shape and encircles the shaft 16, the inner cylindrical portion 12*d* is separated from the outer cylindrical portion 12*c* by the magnetic breaker space 17. However, in the present embodiment, because a magnetic breaker member 17*c* made of non-magnetic material (for example, copper) is installed within the magnetic breaker space 17, the inner cylindrical portion 12*d* and the outer cylindrical portion 12*c* are connected via the magnetic breaker member 17*c*.

A bearing 18 is inserted and connected to the front housing (not illustrated) of the compressor, and rotatably supports the rotor member 12.

Next, a method for manufacturing the pulley integrated type rotor in which the pulley member 11 is integrated with the rotor member 12 will be described. In the drawings, two dotted chain lines denote the final shape of the rotor.

Figure 2:
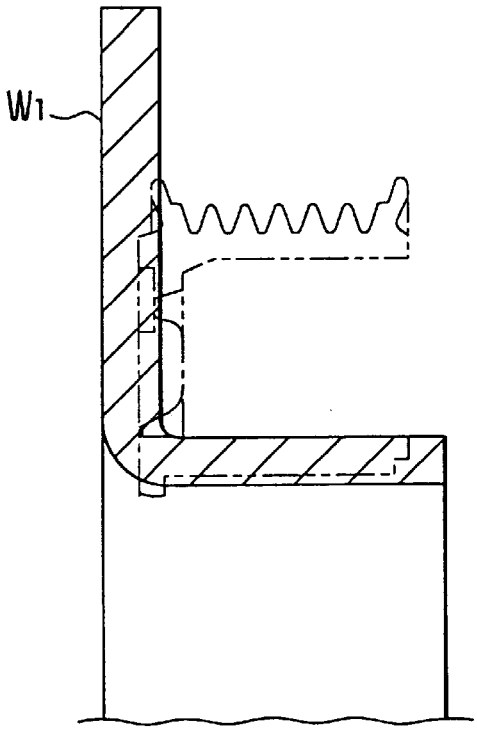
FIGS. 2–4 are cross sectional schematic views showing, in a stepwise manner, a rotor member forming step in a pulley integrated rotor manufacturing process (first embodiment)
Figure 3:
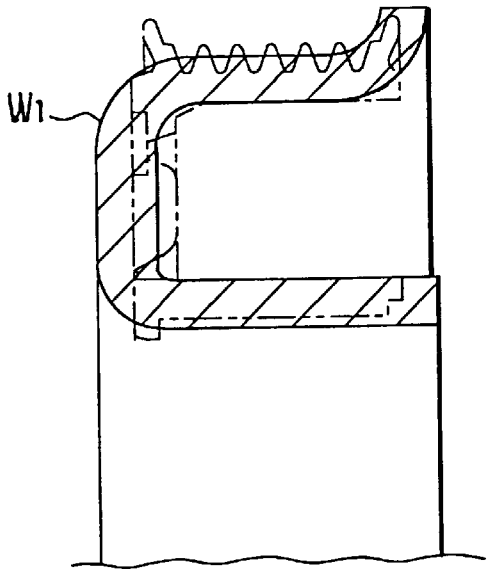
Figure 4:
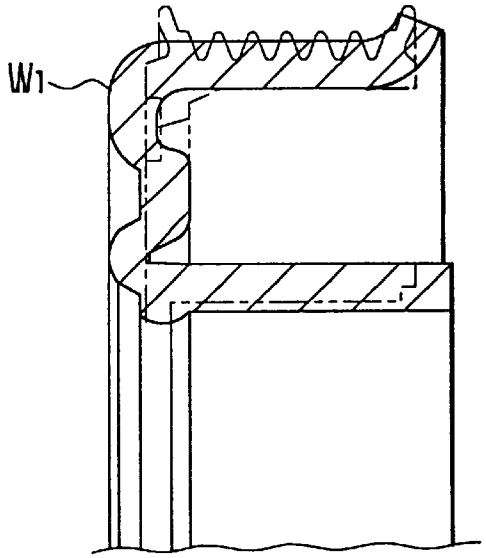

First, as shown in FIGS. 2–4, the rotor portion 12, and concave portions 17*a* corresponding to the magnetic breaker space 17, are formed from disk material W1 made of a steel plate, by plural press-forming steps. Here, the concave portion 17*a* is, as shown in FIG. 4, deformed into a waved-shape by bending a part of the disk material W1 which will function as the bottom portion of the ring-shaped space 12*a*.

Figure 5:
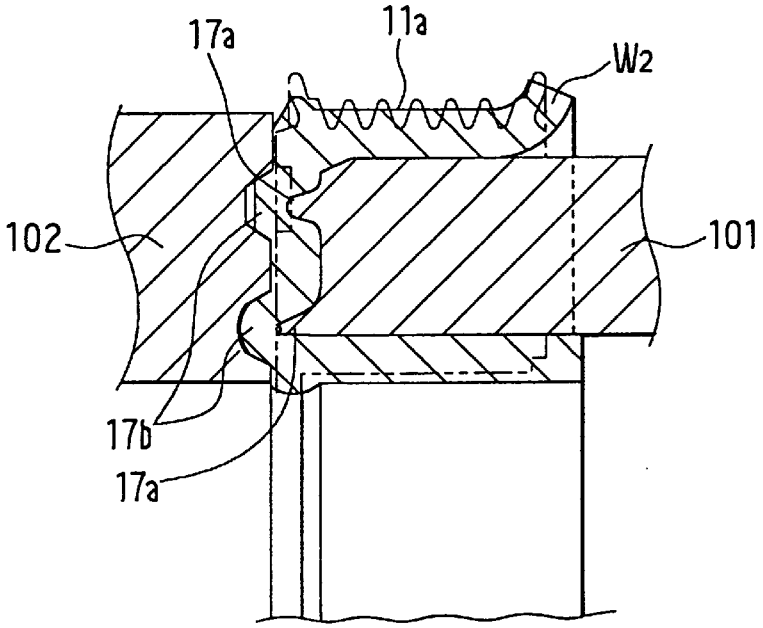
FIG. 5 is a cross sectional schematic view showing a grasping step in the manufacturing process of the pulley integrated type rotor (first embodiment)

Next, as shown in FIG. 5, the rotor member workpiece W2 that was press-formed in the rotor member forming step is grasped by a first jig 101 and a second jig 102. At this time, the first jig 101 is inserted into the concave portions 17*a*, and the second jig 102 is attached to convex portions 17*b* which are formed at the back surface of the concave portions 17*a* when the concave portions 17*a* are press-formed. Here, the outer shape of the second jig 102 is along the back surface of the concave portions 17*a* for interfitting the convex portions 17*b*.

After that, a groove forming roller (not illustrated) is pressed onto a pulley-corresponding portion (outer cylindrical portion 12*c*) which will function as the pulley member to form the pulley grooves 11*a* by roll-forming.

Figure 6:
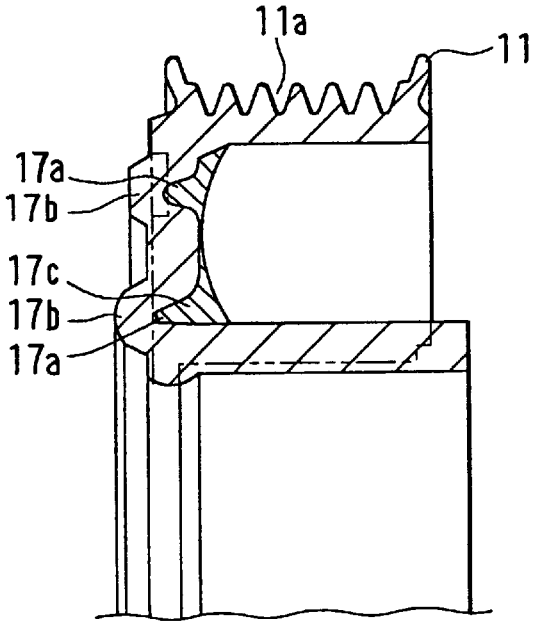
FIG. 6 shows a connecting step in the pulley integrated rotor manufacturing process (first embodiment)

Next, as shown in FIG. 6, the magnetic breaker member 17*c* is deposited in the concave portion 17*a* in a vacuum furnace.

After that, a finishing roller (not illustrated) is pressed onto the previously formed pulley grooves 11*a* to finish the pulley grooves 11*a*.

Figure 7:
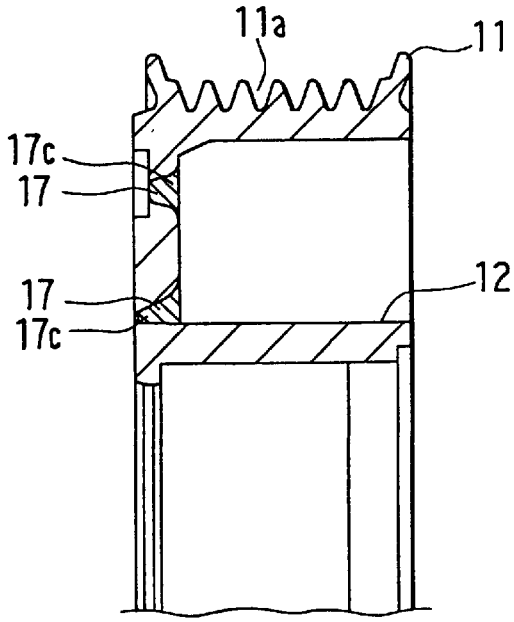
FIG. 7 is a cross sectional schematic view showing a cutting step in the pulley integrated rotor manufacturing process (first embodiment)
Figure 8:
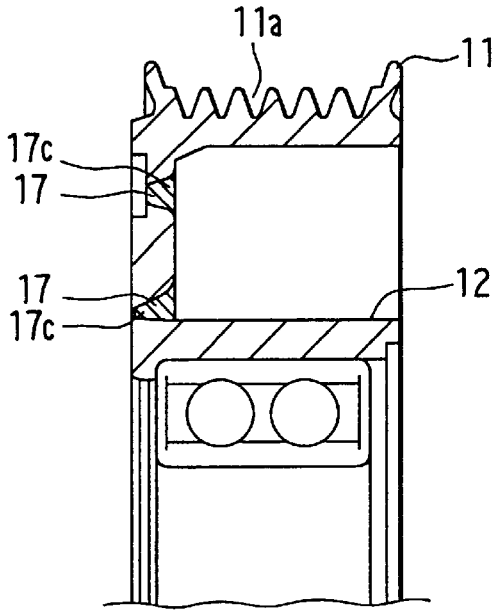
FIG. 8 is a cross sectional schematic view showing a press-inserting step in the pulley integrated rotor manufacturing process (first embodiment)

The convex portions 17*b*, which correspond to the bottom portion of the concave portions 17*a*, are then cut away (FIG. 7) to finish the surface of the rotor member 12 which contacts the armature 14. After that, as shown in FIG. 8, the bearing 18 is press-inserted into the rotor member 12.

Here, because the pressing pressure of the finishing roller is smaller than that of the groove-forming roller, the jigs 101, 102 are unnecessary, and may be removed during the press-inserting step.

In the present embodiment, because the first jig 101 is inserted into the concave portions 17 and the second jig 102 is interfitted to the convex portions 17*b* to grasp the rotor member workpiece W2, the workpiece W2 is firmly grasped. Thereby, the pulley grooves 11*a* are accurately formed, thereby ensuring that the pulley integrated rotor can be manufactured without an increase in the manufacturing cost.

Further, because the workpiece W2 is firmly grasped, the groove forming roller can be pressed onto the workpiece W2 with a high degree of force, thereby shortening the time required for forming the pulley grooves 11*a*.

Incidentally, when the concave portions 17*a* and the convex portion 17*b* are formed by coining step, because the slide-deforming value is large in the coining step, a solid lubricant needs to be provided between the workpiece and the jig. Further, after the coining step, the solid lubricant needs to be eliminated to prevent a lessening of the connection at the magnetic breaker portion 17*c*. That is, a solid lubricant eliminating step such as a step in which the lubricant is removed by shot-brushing (sand-brushing), is needed.

However, in the present embodiment, as the disk material W1 is press-formed by a plurality of repetitions to form the concave portions 17*a* and the convex portions 17*b*, the slide-deformation in one press-forming process is small. Thus, a liquid lubricant such as mold lubricant can be used, and the solid lubricant eliminating process is not needed. Thus, the time for manufacturing the pulley integrated rotor is further reduced.

As above described, according to the present embodiment, because the pulley member 11 and the rotor member 12 are integrally formed, the manufacturing cost is reduced. Also, the concentric accuracy between the pulley portion 11 and the rotor portion 12 can be maintained, while the manufacturing cost is reduced.

(Second Embodiment)

Figure 9:
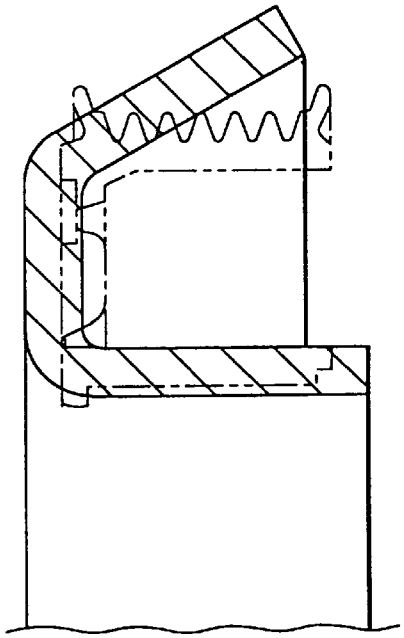
FIG. 9 is a cross sectional view showing a roll-forming step of the pulley integrated type rotor manufacturing process (second embodiment)

In the above-described first embodiment, the rotor forming step is realized through a press-forming process. However, in a second embodiment, as shown in FIG. 9, the rotor forming step is realized by roll-forming process.

Therefore, because the disk material W1 is gradually transformed, a liquid lubricant can be used as in the first embodiment. Thus, a solid lubricant eliminating step is not needed, thereby reducing the manufacturing cost.

(Modifications)

In the above-described embodiments, the pulley member 1 is formed in the outer cylindrical portion 12*c*. Alternatively, as shown in FIGS. 10 and 11, the pulley member 11 may protrude from the outer cylindrical portion 12*c*.

Figure 10:
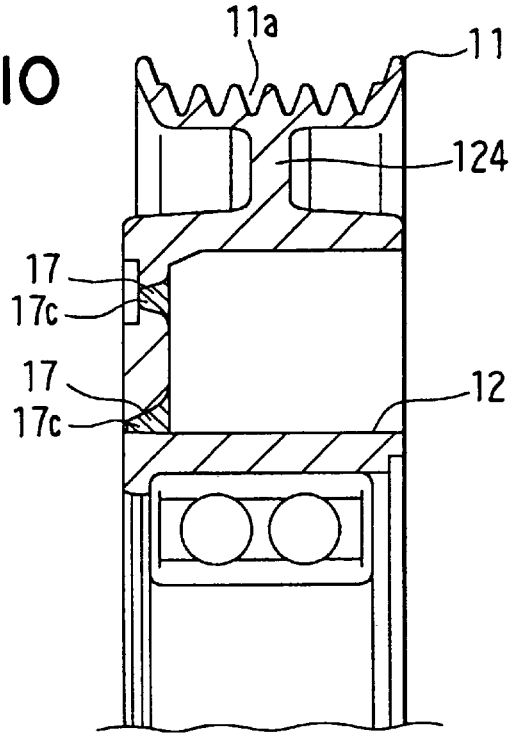
FIG. 10 is a cross sectional view showing a pulley integrated type rotor (second embodiment)
Figure 15:
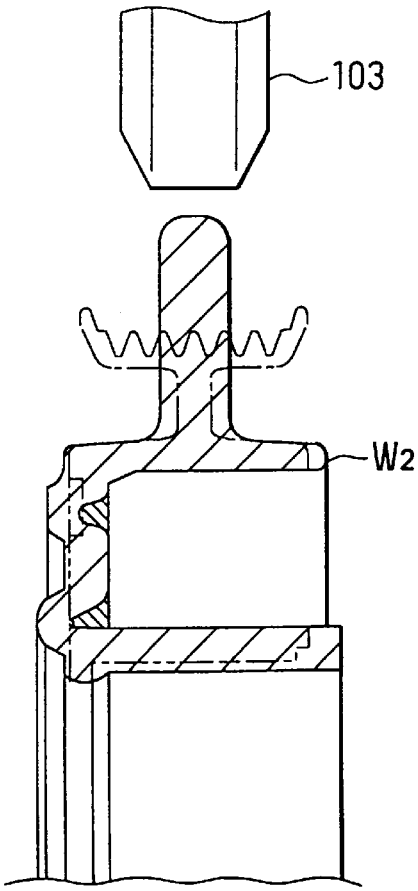
Figure 16:
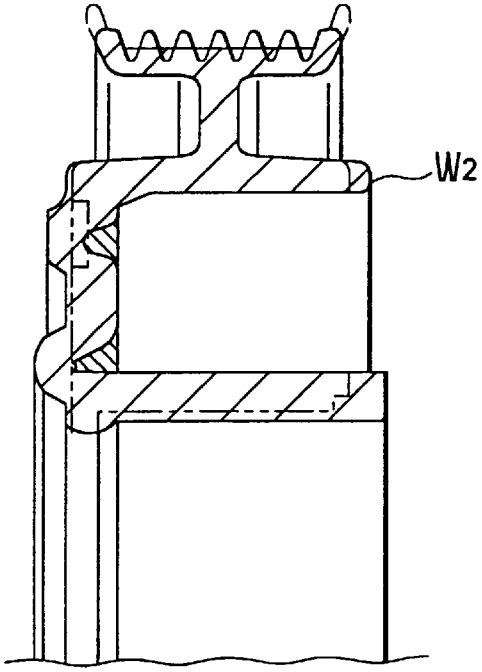
Figure 17:
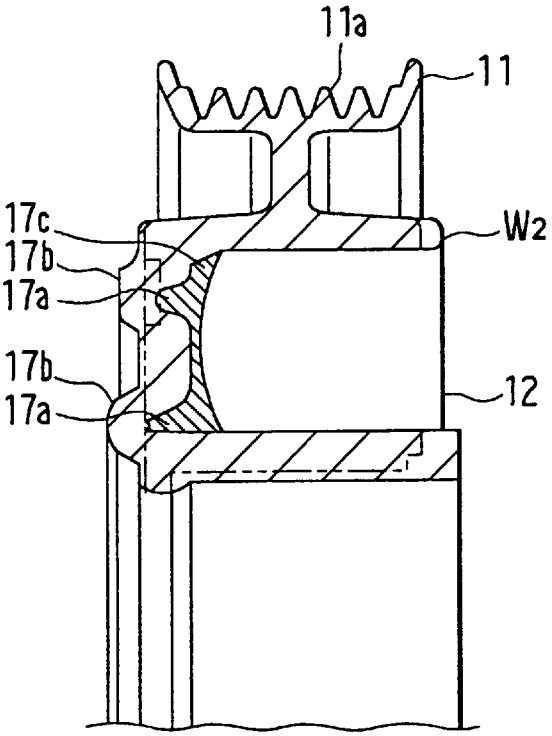
Figure 18:
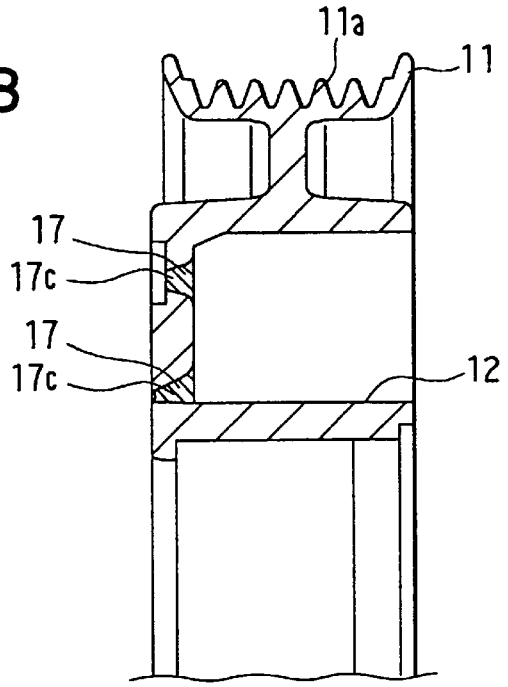
Figure 19:
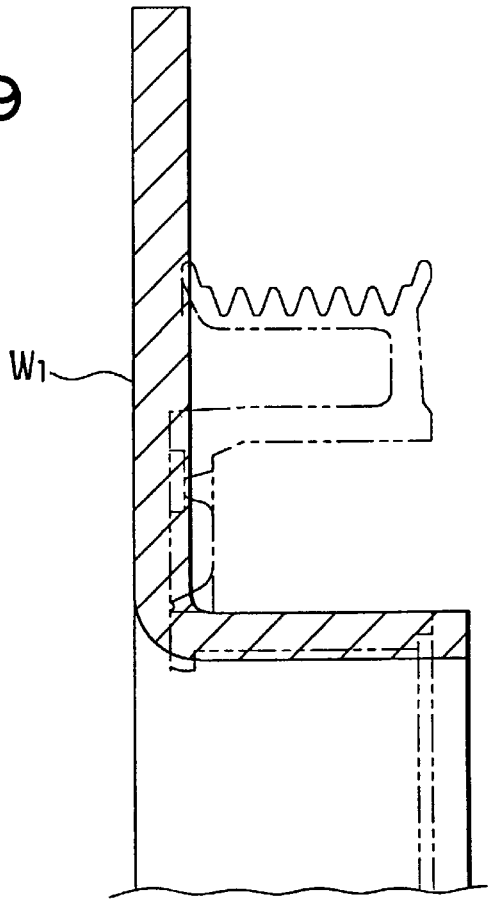
FIGS. 19–23 are cross sectional views showing manufacturing processes of the modified pulley integrated type rotor shown in FIG. 11 (second embodiment)
Figure 20:
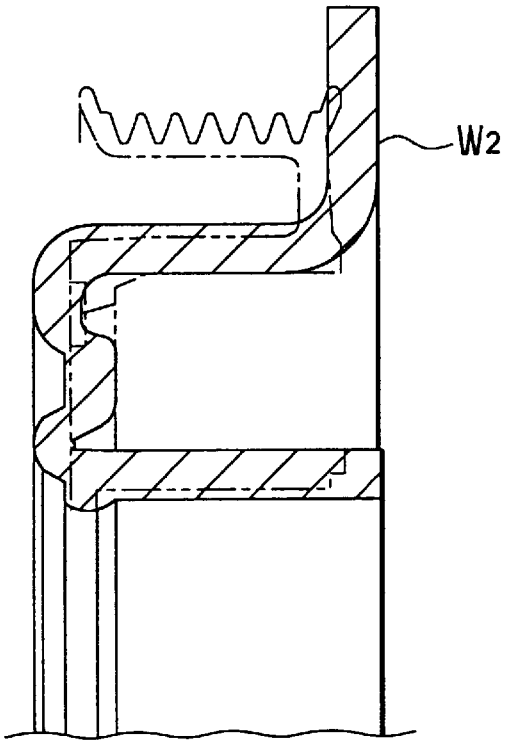
Figure 21:
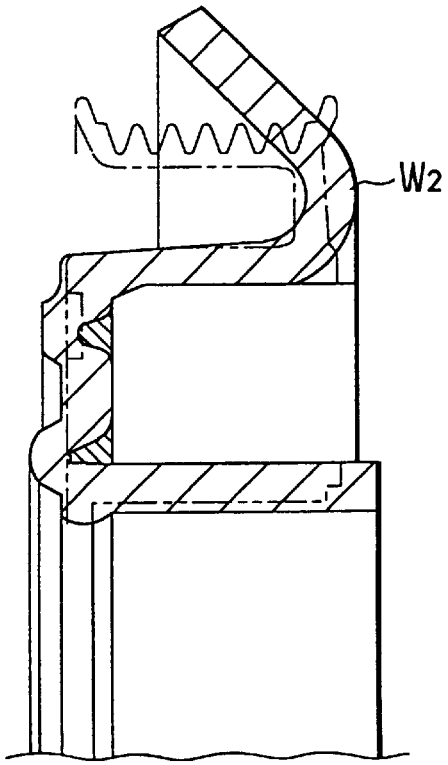
Figure 22:
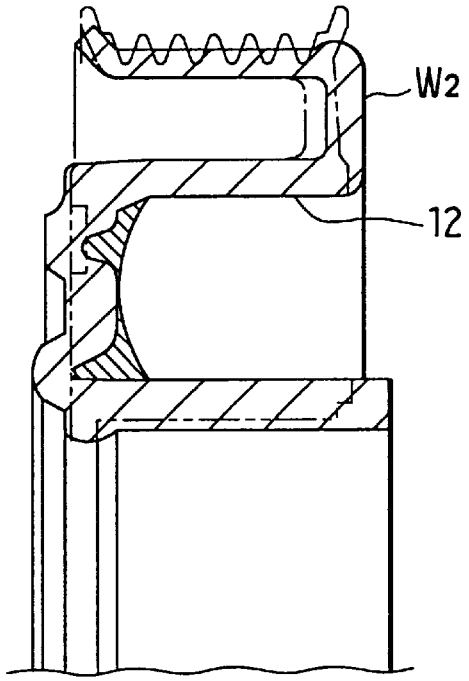
Figure 23:
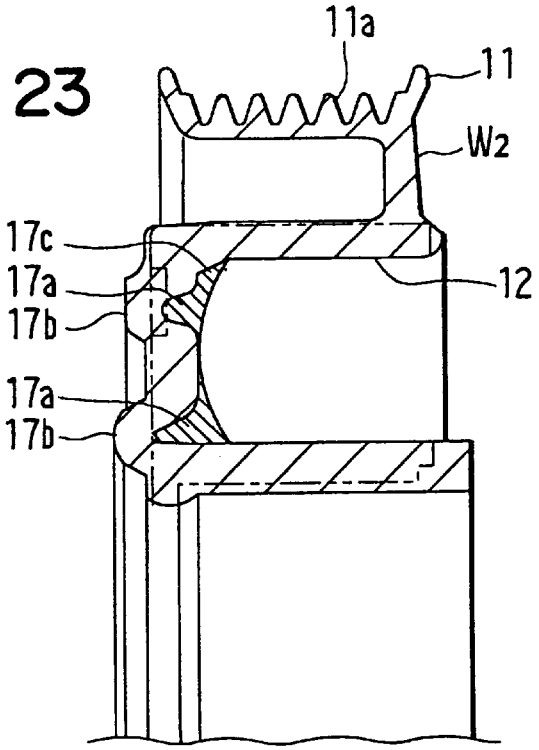
Figure 24:
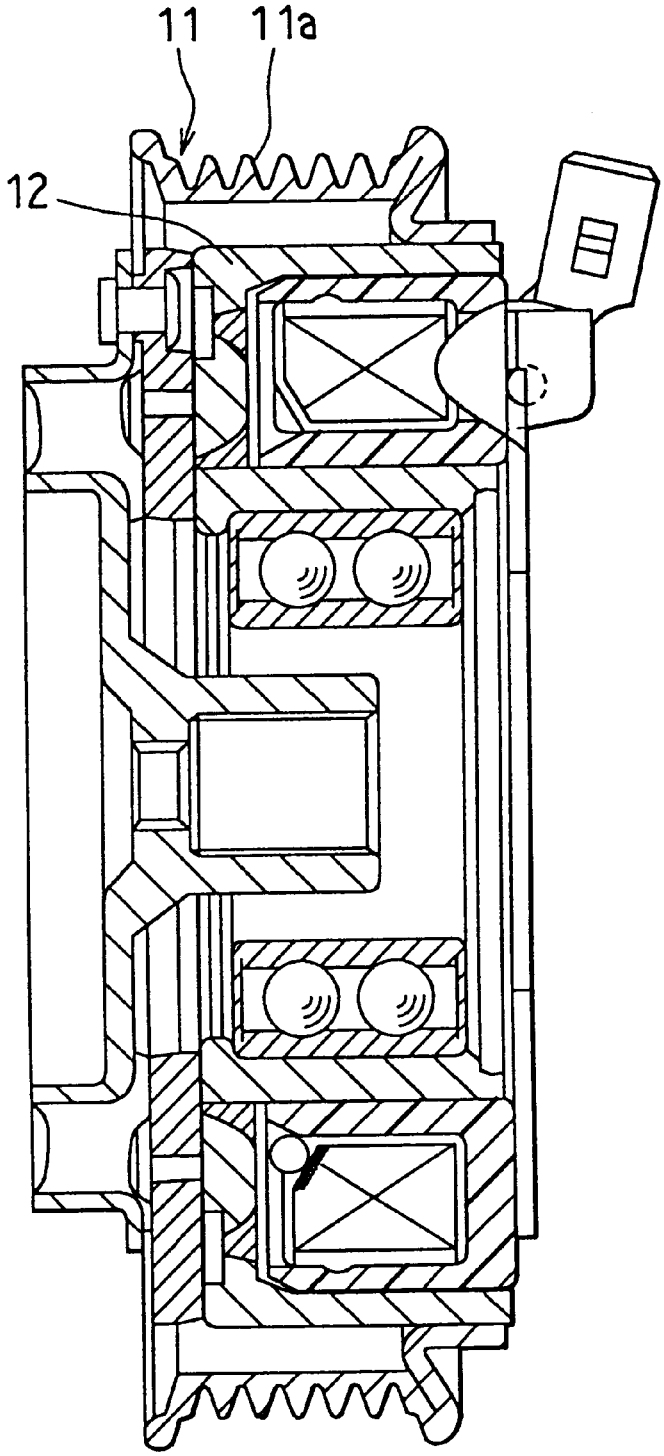
FIG. 24 PRIOR ART
FIG. 24 is a cross sectional view showing a conventional electromagnetic clutch.

Here, FIGS. 12–18 are schematic views showing manufacturing steps of the pulley integrated rotor in FIG. 10. The pulley member 11 is roll-formed through these manufacturing steps. In FIG. 15, a numeral 103 denotes a squashing roller for forming a T-shaped pulley member 11.

Figure 11:
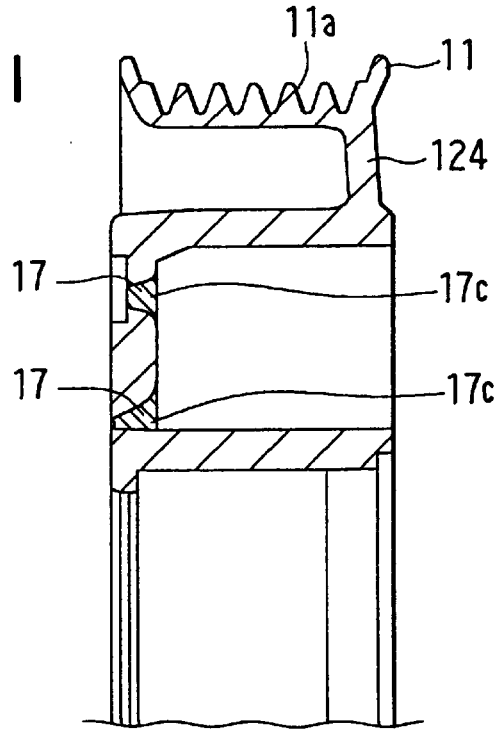
FIG. 11 is a cross sectional view showing a modified pulley integrated rotor (second embodiment)
Figure 12:
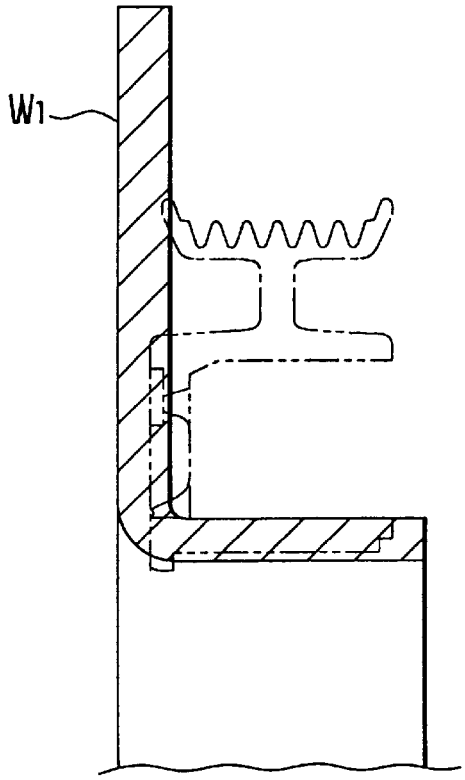
FIGS. 12–18 are cross sectional views showing manufacturing steps for the pulley integrated type rotor shown in FIG. 10 (second embodiment)
Figure 13:
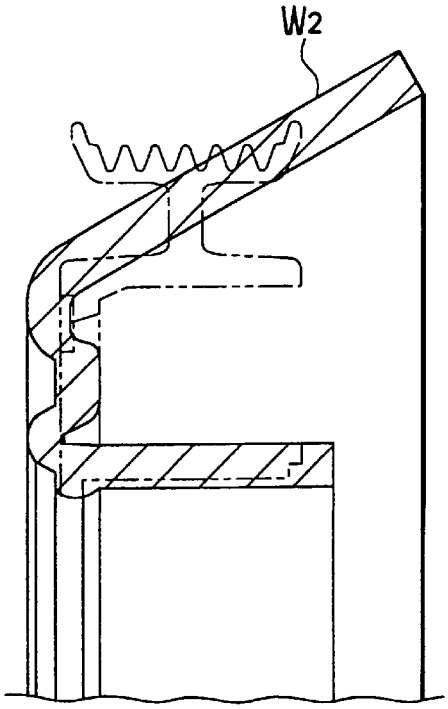
Figure 14:
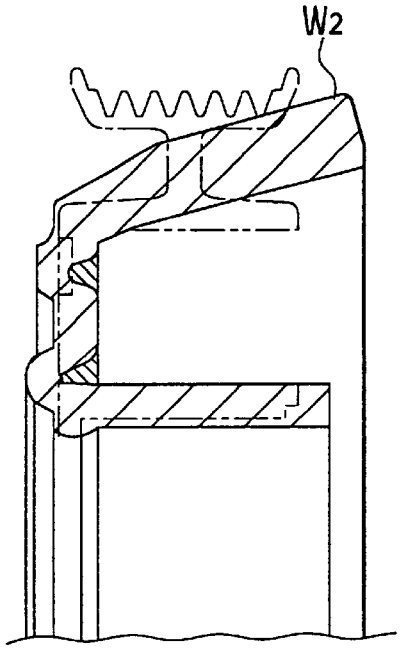

In a similar way, FIGS. 19–23 are schematic views showing manufacturing steps of the pulley integrated rotor in FIG. 11, where the pulley member 11 is roll-formed.

Further, in the above-described embodiments, the magnetic breaking space 17 is ring-shaped. However, the magnetic breaking space 17 may be alternatively formed such as by plural arc-shaped penetrations or plural circle holes. In this case, the rotor member forming step is performed by a press-forming process. Further, in this case, because the outer cylindrical portion 12*c* is not separated from the inner cylindrical portion 12*d*, the magnetic breaking member 17*c* may be eliminated.

In the above-described embodiments, although the depositing step is performed before the finishing step, alternatively, the depositing step may performed after the finishing step.

What is claimed is:

1. A method for manufacturing an electromagnetic clutch having a pulley member including a pulley groove on which a V-belt is hung, a rotor member rotating with said pulley member integrally and performing as a part of a magnetic circuit, and an armature facing and to be attached to said rotor member, said rotor member defining a magnetic breaker space penetrating said rotor member in an axial direction of said electromagnetic clutch, said method comprising:

plastic forming a disk material to form a rotor member workpiece, said rotor member workpiece having two concentric, annular walls and a radially extending wall connecting said annular walls, said walls defining a concave area;

inserting a first jig into said concave area to grasp said rotor member workpiece and support the outer annular wall thereof; and forming said pulley groove in said outer annular wall of said rotor member workpiece by another plastic forming operation.

2. The method for manufacturing an electromagnetic clutch according to claim 1, further comprising forming said workpiece by repeating said another plastic forming operation in the pulley groove forming step.

3. The method for manufacturing an electromagnetic clutch according to claim 1, wherein the pulley groove forming step further comprises forming said workpiece by a roll-forming process.

4. The method for manufacturing an electromagnetic clutch according to claim 1, further comprising attaching a second jig to a convex area formed at a back surface of said concave area when said concave area is formed.

5. The method for manufacturing an electromagnetic clutch according to claim 1, further comprising depositing a magnetic breaker member in said concave area.

6. The method for manufacturing an electromagnetic clutch according to claim 5, wherein said magnetic breaker member is made of non-magnetic material such as copper.

* * * * *